US006848967B2

(12) United States Patent
Kim

(10) Patent No.: US 6,848,967 B2
(45) Date of Patent: Feb. 1, 2005

(54) TRANSFORMABLE TOY

(76) Inventor: Ik Sung Kim, D-612, Msung Apartment, 37 Yeoeuido-Dong Yeongdeungpo-Gu, Seoul (KR)

( * ) Notice: Subject to any disclaimer, the term of this patent is extended or adjusted under 35 U.S.C. 154(b) by 0 days.

(21) Appl. No.: 10/672,503

(22) Filed: Sep. 26, 2003

(65) Prior Publication Data

US 2004/0192158 A1 Sep. 30, 2004

(30) Foreign Application Priority Data

Mar. 31, 2003 (KR) ..... 20-2003-0009758

(51) Int. Cl.[7] ..... A63H 3/02
(52) U.S. Cl. ..... 446/369; 446/390; 446/901
(58) Field of Search ..... 446/320, 321, 446/369, 376, 385, 390, 97, 99, 489, 330, 901

(56) References Cited

U.S. PATENT DOCUMENTS 3,789,547 A * 2/1974 Chemarin ..... 446/369
4,170,086 A * 10/1979 Hills ..... 446/372
4,729,751 A * 3/1988 Schiavo et al. ..... 446/268
5,362,271 A * 11/1994 Butt ..... 446/139
5,507,678 A * 4/1996 Chiang ..... 446/369

* cited by examiner

*Primary Examiner*—Jacob K. Ackun, Jr.
(74) *Attorney, Agent, or Firm*—Thomas I. Rozsa; Tony D. Chen

(57) ABSTRACT

A transformable toy with which children play, wherein arms of the toy are formed integrally with legs of the toy, respectively, and the arms and the legs easily pass through-holes formed in a body part of the toy in such a manner that the lengths of the arms are longer than those of the legs or the lengths of the legs are longer than those of the arms so that the transformable animal toy can hang on an object, such as a rope or a bar, or the transformable animal toy can hug another toy, thereby improving a sense of mystery thereof. The transformable toy comprises a body part having an outer cover and an inner cover, and a head part. The body part has through-holes longitudinally formed therethrough at both sides thereof, respectively through which a respective arm and leg combination are inserted.

1 Claim, 4 Drawing Sheets

TRANSFORMABLE TOY

BACKGROUND OF THE INVENTION

1. Field of the Invention

The present invention relates to a transformable toy with which children play, and more particularly to a transformable animal toy wherein arms of the toy are formed integrally with legs of the toy, respectively, and the arms and the legs easily pass through through-holes formed in a body part of the toy in such a manner that the lengths of the arms are longer than those of the legs or the lengths of the legs are longer than those of the arms so that the transformable animal toy can hang on an object, such as a rope or a bar, or the transformable animal toy can hug another toy, thereby improving a sense of mystery thereof.

2. Description of the Related Art

Generally, toys are classified into cloth toys and plastic toys. Furthermore, the toys may be formed in the shape of a human being or animals.

Such toys are manufactured on the basis of shapes or body actions of the human being or the animals to increase special characters of the toys so that a sense of beauty or a sense of mystery of the toys is improved. Consequently, the toys can be widely used as playing toys.

However, the toys cannot be transformed from the original shape to another shape. As a result, the sense of mystery of the toys easily disappears as time goes by. Consequently, children are tired of playing with the toys, and want to discard the toys which they have grown tired of and acquire new toys.

In order to solve the above-mentioned drawback, assembly-type transformable toys, shapes of which can be easily changed by user of the toys, for example, children, have been proposed recently. However, most of the assembly-type transformable toys are plastic toys. No transformable cloth toys have yet been developed.

SUMMARY OF THE INVENTION

Therefore, the present invention has been made in view of the above problems, and it is an object of the present invention to provide a transformable cloth toy wherein arms of the toy are formed integrally with legs of the toy, respectively, and the arms and the legs easily pass through through-holes formed in a body part of the toy in such a manner that the lengths of the arms are longer than those of the legs or the lengths of the legs are longer than those of the arms so that the transformable cloth toy can be transformed as a toy with relatively longer arms or as a toy with relatively longer legs according to the needs or desires of a user, thereby further improving a practical usability and a sense of mystery thereof.

In accordance with the present invention, the above and other objects can be accomplished by the provision of a transformable toy comprising: a body part having an outer cover and an inner cover, and a head part; through-holes longitudinally formed through the body part at both sides thereof, respectively, the through-holes being connected between shoulder connection parts and leg connection parts, respectively; and arm parts and leg parts, each of the arm parts comprising a hand and an arm, each of the leg parts comprising a foot and a leg, the arm parts being formed integrally with the leg parts, respectively, wherein the integrally formed arm and leg parts pass through the through-holes longitudinally formed through the body part at both sides thereof, respectively, so that the lengths of the arm parts increase while the lengths of the leg parts decrease or the lengths of the arm parts decrease while the lengths of the leg parts increase.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a transformable toy according to a preferred embodiment of the present invention will be described in detail with reference to the accompanying drawings.

Figure 1:
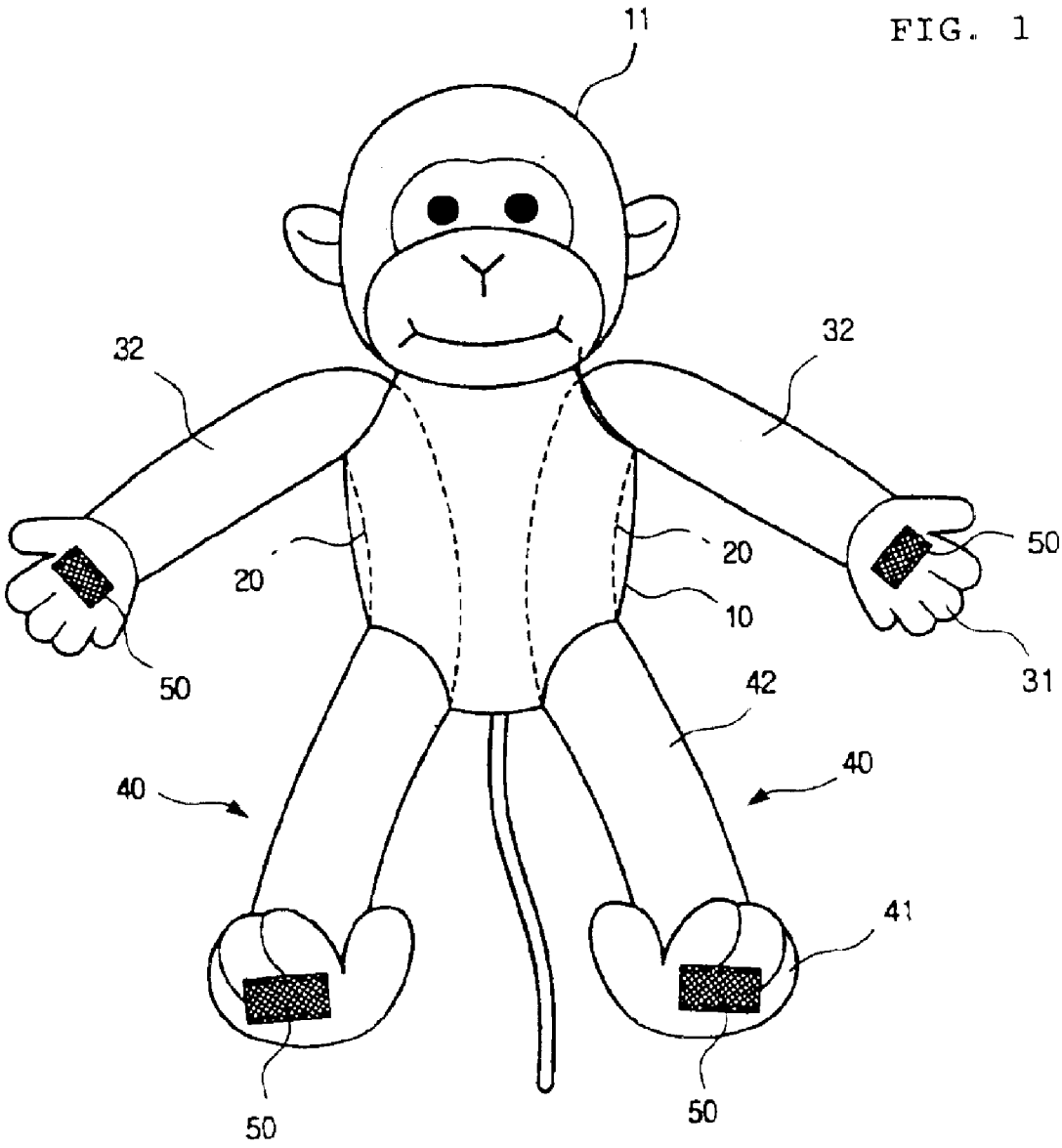
FIG. 1 is a front view of a transformable toy according to a preferred embodiment of the present invention.
Figure 2:
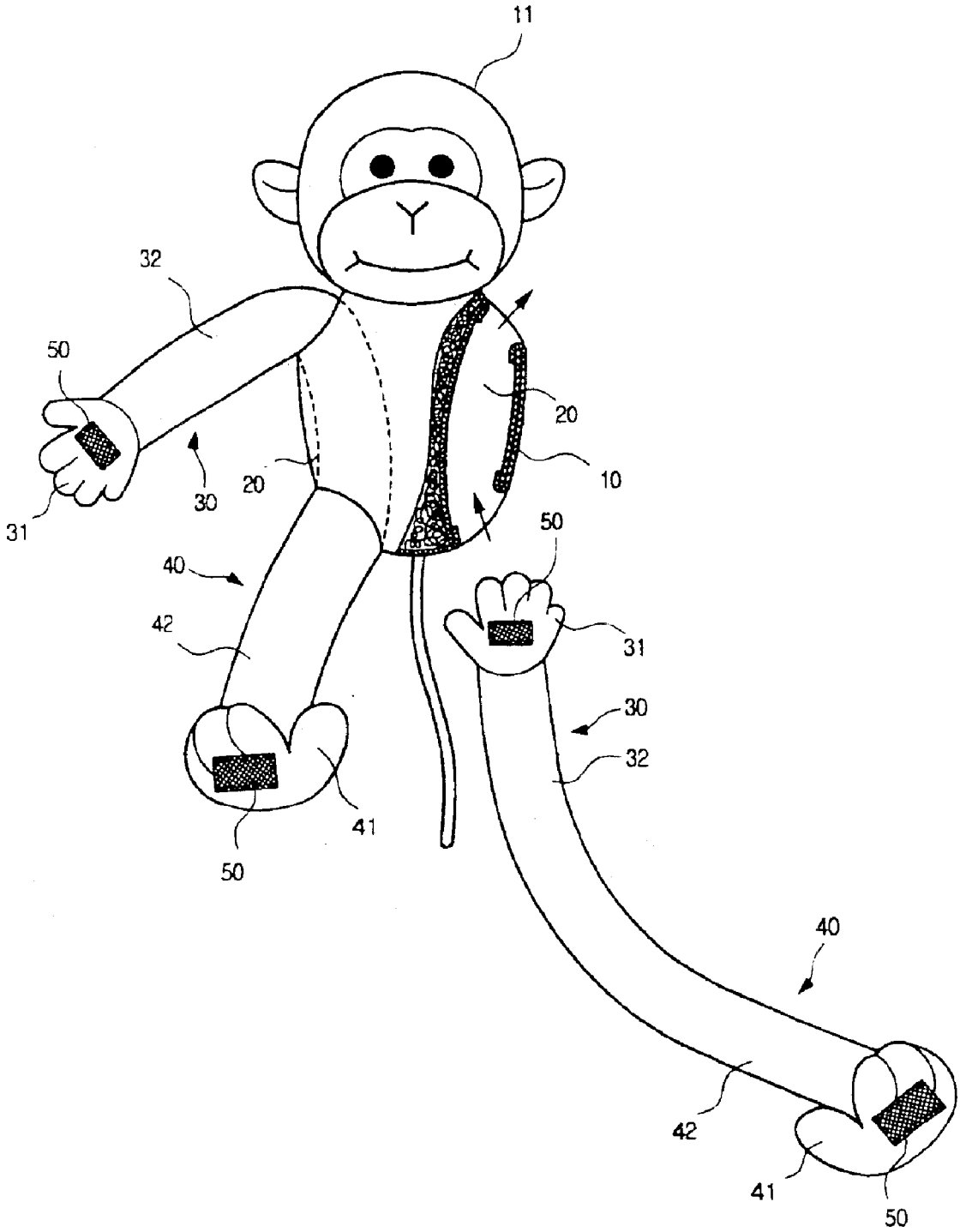
FIG. 2 is an exploded front view, partially in section, of the transformable toy according to the preferred embodiment of the present invention.
Figure 3A:
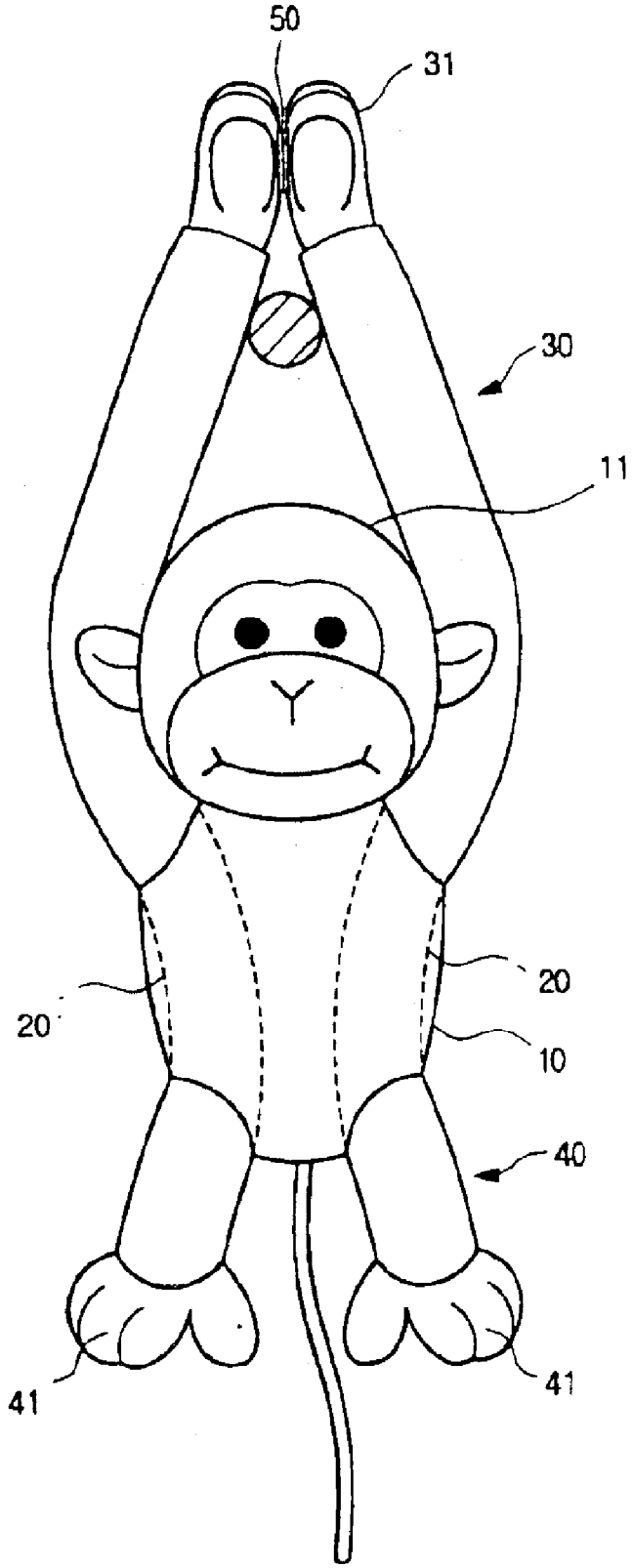
FIGS. 3*a* and 3*b* are front views of the transformable toy according to the preferred embodiment of the present invention respectively illustrating how the transformable toy is used.
Figure 3B:
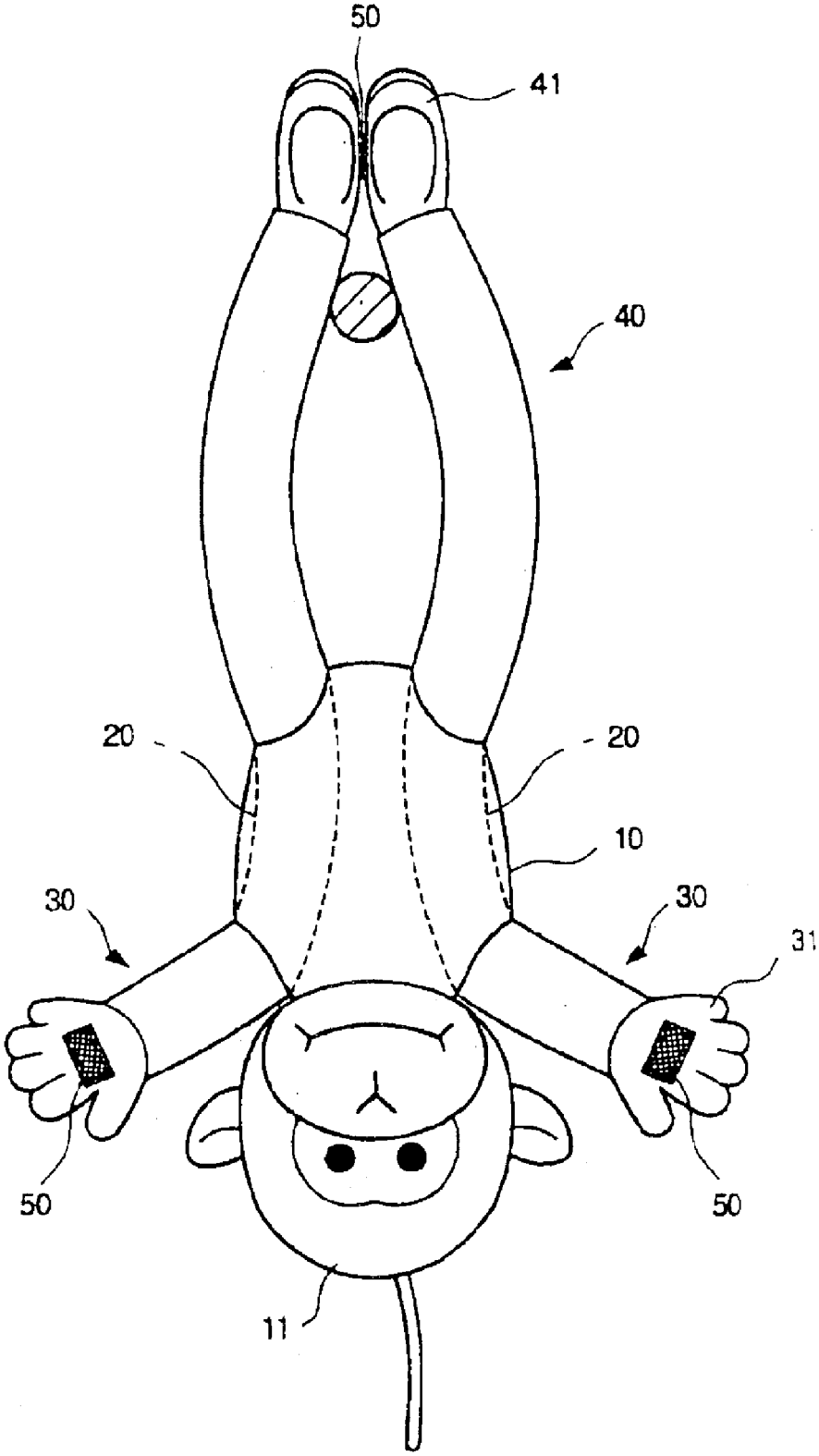

FIG. 1 is a front view of a transformable toy according to a preferred embodiment of the present invention, FIG. 2 is an exploded front view, partially in section, of the transformable toy according to the preferred embodiment of the present invention, and FIGS. 3*a* and 3*b* are front views of the transformable toy according to the preferred embodiment of the present invention respectively illustrating how the transformable toy is used.

As shown in the drawings, the transformable toy comprises a body part 10 having an outer cover and an inner cover, and a head part 11.

The body part 10 has two through-holes 20 longitudinally formed therethrough at both sides thereof, respectively. The through-holes 20 are connected between shoulder connection parts and leg connection parts, respectively.

The transformable toy further comprises two arm parts 30, each of which comprises a hand 31 and an arm 32, and two leg parts 40, each of which comprises a foot 41 and a leg 42. The arm parts 30 are formed integrally with the leg parts 40, respectively. The integrally formed arm and leg parts 30 and 40 pass through the through-holes 20 longitudinally formed through the body part at both sides thereof, respectively.

On the palm of the hand 31 of each of the arm parts 30 is attached a hook and loop fastener 50. Similarly, on the sole of the foot 41 of each of the leg parts 40 is attached another hook and loop fastener 50. Consequently, the hand 31 of one of the arm parts 30 can be attached to the hand 31 of the other of the arm parts 30 so that the toy can hang on an object, such as a rope or a bar, or the toy can hug another toy. Similarly, the foot 41 of one of the leg parts 40 can be attached to the foot 41 of the other of the leg parts 40 so that the toy can hang on an object, such as a rope or a bar, or the toy can hug another toy. Alternatively, the hands 31 of the arm parts 30 can be attached to the feet 41 of the leg parts 40, respectively, so that the toy can hang on the rope or the bar, or the toy can hug another toy.

The operation of the transformable toy with the above-stated construction according to the preferred embodiment of the present invention will now be described in detail with reference to the accompanying drawings.

FIG. 1 is a front view of a transformable toy according to a preferred embodiment of the present invention, FIG. 2 is an exploded front view, partially in section, of the transformable toy according to the preferred embodiment of the present invention, and FIGS. 3*a* and 3*b* are front views of the transformable toy according to the preferred embodiment of the present invention respectively illustrating how the transformable toy is used. As shown in the drawings, the body part 10 of the transformable toy is attached to the head part 11 of the transformable toy. The through-holes 20 are longitudinally formed through the body part 10 of the transformable toy at both sides thereof, respectively. As mentioned above, the through-holes 20 are connected between the shoulder connection parts and the leg connection parts, respectively. The arm parts 30 are formed integrally with the leg parts 40, respectively. The integrally formed arm and leg parts 30 and 40 pass through the through-holes 20 longitudinally formed through the body part at both sides thereof, respectively. In this way, the transformable toy is prepared.

The transformable toy of the present invention can hang on a rope disposed at a high place, a bar disposed at a high place, or another bar extended outwardly from an article of furniture, to improve the decorative effect of the transformable toy. At this time, the transformable toy can be transformed as a toy with relatively longer arms or as a toy with relatively longer legs. Specifically, the arm parts 30 may be pulled from the body part 10 of the transformable toy. As a result, the lengths of the arm parts 30 increase while the lengths of the leg parts 40 decrease.

The long arm parts 30 of the transformable toy are attached to each other by means of the Velcro tapes 50 on the palms of the hands 31 of the arm parts 30. As a result, the transformable toy can hang on a bar as shown in FIG. 3*a*. In this manner, the decorative effect of the transformable toy is increased, and the aesthetic sense of the transformable toy is also increased.

On the other hand, the leg parts 40 may be pulled from the body part 10 of the transformable toy. As a result, the lengths of the leg parts 40 increase while the lengths of the arm parts 30 decrease.

The long arm parts 30 of the transformable toy are attached to each other by means of the hook and loop fasteners 50 on the soles of the feet 41 of the leg parts 40. As a result, the transformable toy can hang on a bar as shown in FIG. 3*a*. In this manner, the decorative effect of the transformable toy is increased, and the aesthetic sense of the transformable toy is also increased.

In this embodiment, the transformable toy is formed in the shape of a monkey. Accordingly, the transformable monkey toy can hang on the bar, as shown in FIG. 3*a*, as a real monkey hangs on a branch of a tree. Also, the transformable monkey toy can hang on the bar upside down, as shown in FIG. 3*b*, as a real monkey hangs on a branch of a tree upside down.

It should be noted, however, that the present invention is not limited to the above-mentioned monkey toy. For example, the transformable toy of the present invention may be formed in the shape of a bear, a sluggard, or a koala, which lives on a tree. It should also be noted that the transformable toy of the present invention may be formed in the shape of a human being. All of the transformable toys formed in the shapes of the above-mentioned animals or the human being fall under the scope of the present invention.

As apparent from the above description, the present invention provides a transformable toy wherein arms of the toy are formed integrally with legs of the toy, respectively, and the arms and the legs easily pass through through-holes formed in a body part of the toy in such a manner that the lengths of the arms are longer than those of the legs or the lengths of the legs are longer than those of the arms so that the transformable toy can be easily transformed as a toy with relatively longer arms or as a toy with relatively longer legs, whereby the aesthetic sense of the transformable toy is improved, the value of the transformable toy is increased, the decorative effect of the transformable toy is increased.

Furthermore, the construction of the transformable toy of the present invention is simple, whereby the transformable toy can be easily and economically manufactured.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A transformable toy comprising:

a body part having an outer cover and an inner cover, and a head part;

through-holes longitudinally formed through the body part at both sides thereof, respectively, the through-holes being connected between shoulder connection parts and leg connection parts, respectively;

arm parts and leg parts, each of the arm parts comprising a hand and an arm, each of the leg parts comprising a foot and a leg, the arm parts being formed integrally with the leg parts, respectively;

each hand further comprising a mating hook and loop fastener and each foot further comprising a mating hook and loop fastener so that the two hands may be fastened together, the two feet may be fastened together or a foot and a hand may be fastened together to enable the transformable toy to hang from an object;

wherein the integrally formed arm and leg parts pass through the through-holes longitudinally formed through the body part at both sides thereof, respectively, so that the lengths of the arm parts increase while the lengths of the leg parts decrease or the lengths of the arm parts decrease while the lengths of the leg parts increase.

* * * * *